US005231742A

United States Patent [19]

Macbain

[11] Patent Number: 5,231,742

[45] Date of Patent: Aug. 3, 1993

[54] HAND TWINING LOOMS

[76] Inventor: Kathleen E. Macbain, 9125 Copper NE, Apt. 320, Albuquerque, N. Mex.

[21] Appl. No.: 895,521

[22] Filed: Jun. 8, 1992

[51] Int. Cl.[5] ..... D03D 29/00

[52] U.S. Cl. ..... 28/151; 139/34

[58] Field of Search ..... 289/16.5, 17; 139/383 AA, 29, 34; 66/1 A, 1 S, 2, 3, 193, 169 R, 1 R, 117, 118; 28/144, 145, 147, 149, 152, 151, 150; 223/6, 120; 87/10-13, 53, 62

[56] References Cited

U.S. PATENT DOCUMENTS

| | | | |
|---|---|---|---|
| 1,317,367 | 9/1919 | Hansen . | |
| 1,675,881 | 7/1928 | Denney . | |
| 1,975,924 | 10/1934 | Collingborn . | |
| 2,065,498 | 12/1936 | Bacheller . | |
| 2,166,668 | 7/1939 | Webster et al. . | |
| 2,224,563 | 12/1940 | Clark . | |
| 2,463,365 | 3/1949 | Epstein | 139/34 |
| 2,803,051 | 8/1957 | Gutzmann . | |
| 3,530,558 | 9/1970 | Gick . | |
| 3,739,437 | 6/1973 | Alberici et al. . | |
| 3,971,417 | 7/1976 | Gentil . | |
| 4,192,046 | 3/1980 | van den Bosch-Meevis et al. . | |

FOREIGN PATENT DOCUMENTS

| | | | |
|---|---|---|---|
| 1003305 | 1/1977 | Canada . | |
| 1044573 | 12/1978 | Canada . | |
| 1318276 | 3/1962 | France | 28/152 |
| 250243 | 5/1926 | Italy | 28/152 |
| 164808 | 1/1934 | Switzerland . | |
| 258565 | 6/1945 | Switzerland . | |

*Primary Examiner*—Andrew M. Falik
*Attorney, Agent, or Firm*—DeWitt M. Morgan

[57] ABSTRACT

An apparatus and method for twining or weaving. The apparatus includes a plurality of elongated loom fingers and a loom. Each of the loom fingers is elongated, has first and second symmetrical tapered ends, and has an elongated groove running the entire length thereof. The loom includes: a first support that includes at least one plate-like member having a plurality of through holes therein which loosely support the loom fingers in a substantially parallel manner; a second support that has a finger engagement surface which, in the assembled form, is adopted to engage one of the ends of each loom finger being used; and structure for detachably supporting the plate-like member altitudinally with respect to the second support. In operation, to disengage the loom fingers, the plate-like member is moved relative to the second support and, then, the plate-like member is moved toward the end of the loom fingers which had previously been in contact with the finger engagement surface.

25 Claims, 10 Drawing Sheets

HAND TWINING LOOMS

TECHNICAL FIELD

The present invention relates generally to devices for performing handicraft activities, and more particularly to hand weaving looms.

BACKGROUND OF THE INVENTION

Handicraft activities have always enjoyed popularity for both educational and recreational purposes. Activities such as knitting, needlepoint, crocheting, and the like enhance manual dexterity and coordination, provide relaxation, and provide the satisfaction of creating a handmade article.

A number of hand weaving looms are disclosed in the prior art including: U.S. Pat. Nos. Re. 30,656, 4,192,046, 3,971,417, 2,739,437, 3,530,558, 2,803,051, 2,726,434, 2,563,510, 2,224,563, 2,166,668, 2,065,498, 1,975,924, 1,675,881, and 1,317,367; Canadian patents Nos. 1,044,573 and 1,003,305; and Swiss patents Nos. 258,565 and 164,808.

U.S. Pat. No. Re. 30,656 to Davitian discloses a weaving apparatus that includes a base portion 4, formed of resinous material, wood or metal. Mounted in and extending from base 4 are a plurality of elongated rods 8, which may be permanently or removably mounted in base 4 to form a comb-like frame assembly. The free end 22 of each rod 8 is notched. Notches 24 and lug posts 6 formed on base portion 4 cooperate to support the weft.

In the apparatus disclosed in van der Bosch-Meeves et al., U.S. Pat. No. 4,192,046, a locking apparatus, including lower block 1 and upper block 2, is used to hold a plurality of wooden weaving bars 11. At one end thereof, bars 11 have hooks 15 to which warp threads 18 are attached. In operation, those portions of bars 11 upon which the weft threads have already been drawn are locked between blocks 1 and 2 and the weaving proceeds on the ends opposite to hooks 15.

Gentil, U.S. Pat. No. 3,971,417 discloses a hand loom formed of a first set of needles $2_{1,3,5...13}$ held by holder 3 and a second set of parallel and alternating needles $2_{2,4,6...14}$ held by a second holder 5. All of these needles have at one end, a semicircular hook. At the opposite end each needle has a flattened region having an eye therein through which a warp filament is threaded. Holder 3 and the needles secured to it are movable laterally relatively to holder 5, to permit the odd numbered hooks to move relatively to the even number of hooks as the weft filament 17 is laid.

U.S. Pat. No. 3,739,437 discloses a weaving device in the form of a comb with a first set of fingers 36 being somewhat longer than a second set of fingers 38. This permits fingers 36 to be easily deflected relative to fingers 38 during the weaving process. U.S. Pat. No. 2,166,688 discloses a similar device.

Bacheller, U.S. Pat. No. 2,065,498 discloses what is described as a comb loom including a base 13 having a plurality of evenly spaced grooves 14. Fixed in the grooves are a like plurality of channel members 15. In addition to a straight base, a circular block 34 may be used to support the channel members. The open channel in each of members 15 permits a bodkin 20, to which is attached the warp thread, to pass through the weft. The bodkin has to be flexible to work and the channel members have to face in the same direction and align with the grooves 14. After the desired piece has been woven on the loom it is, presumably, worked off members 15 with great difficulty. Denney, U.S. Pat. No. 1,675,881 also discloses a comb-like weaving structure in which a plurality of bars 19 are locked in a parallel arrangement by a timber 12 and a mating clamping bar or plate 13. Similarly, U.S. Pat. No. 1,317,367 to Hansen discloses a plurality of needles 10 firmly held by a holder of sheet metal. Swiss patents Nos. 258,565 and 164,808 appear to disclose similar structures.

The benefits associated with handicraft activities can be particularly important when working with children, including handicapped children, or with persons having learning and physical disabilities. For children, these activities can be stimulating and entertaining, and help instill the motivation required for initiating a project and following it through to completion. For persons having learning or physical disabilities, handicraft activities also provide rehabilitation and therapy, and can provide feelings of accomplishment and pride that come with creating an attractive craft item from simple starting materials. Even the set up of the loom provides a beneficial fine motor activity.

While activities such as knitting and needlepoint can be performed to make both useful and decorative items, these activities may be too complex and time-consuming for children and the learning or physically disabled. Handicrafts for these people can be most rewarding if they can be easily learned, and readily performed to create a finished article in a relatively short time. A handicraft activity which can be easily learned in a simple form, and can be further practiced employing more sophisticated techniques, is particularly desirable.

To this end, the present invention concerns a hand weaving device which: (1) is straightforward in construction for economical manufacture; (2) is easy to use; and (3) lends itself to use in various ways to permit practice of more sophisticated techniques as proficiency with the device is gained.

SUMMARY OF THE INVENTION

A method and apparatus for twining or weaving. The apparatus includes a plurality of elongated loom fingers and a loom. Each of the loom fingers is elongated, has first and second symmetrical tapered ends, and has an elongated groove running the entire length thereof. The loom includes: a first support that includes at least one plate-like member having a plurality of through holes therein which loosely support the loom fingers in a substantially parallel manner; a second support that has a finger engagement surface which, in the assembled form is adopted to engage one of the ends of each loom finger being used; and structure for detachably supporting the plate-like member altitudinally with respect to the second support.

The number of through openings in the plate-like member depends upon its size and shape. The through openings are arranged in one or more patterns, including straight lines, circles and/or ovals, or portions thereof. The pattern selected and the number of loom fingers used is at the discretion of the user.

In one embodiment, the second support is an elongated channel, with the structure for detachably supporting including a tongue and groove arrangement. In another embodiment, the second support includes a raised annular ring which has a lip thereon. The plate-like member is disc shaped and has an edge which cooperates with the lip for relative rotation thereto. In a third embodiment the loom is in the form of a box like structure, with both the top and bottom have a hole pattern therein. In this case, the first support includes an intermediate master plate; the second support includes a tray for supporting this plate.

The method includes: positioning the plate-like member relative to the finger engagement surface; positioning the desired plurality of loom fingers in the through holes; wrapping or twining weft on the loom fingers; disengaging the plate-like member from the second support; moving the plate-like member relative to the finger ends which were in contact with the finger engaging surface; removing the fingers and the weft, as a unit, from the plate-like member; inserting the warp (from either end); and removing the loom fingers (without distorting the weaving). The loom fingers and weft can be repositioned relative to the second support with the opposite ends of the loom fingers in contact with the engaging surface, to reverse the direction of the weaving/twining of the weft.

The invention also contemplates the use of closed loop material as the weft, wherein the finger on which one loop ends is the same finger for starting the next loop.

DESCRIPTION OF THE PREFERRED EMBODIMENTS

Figure 1:
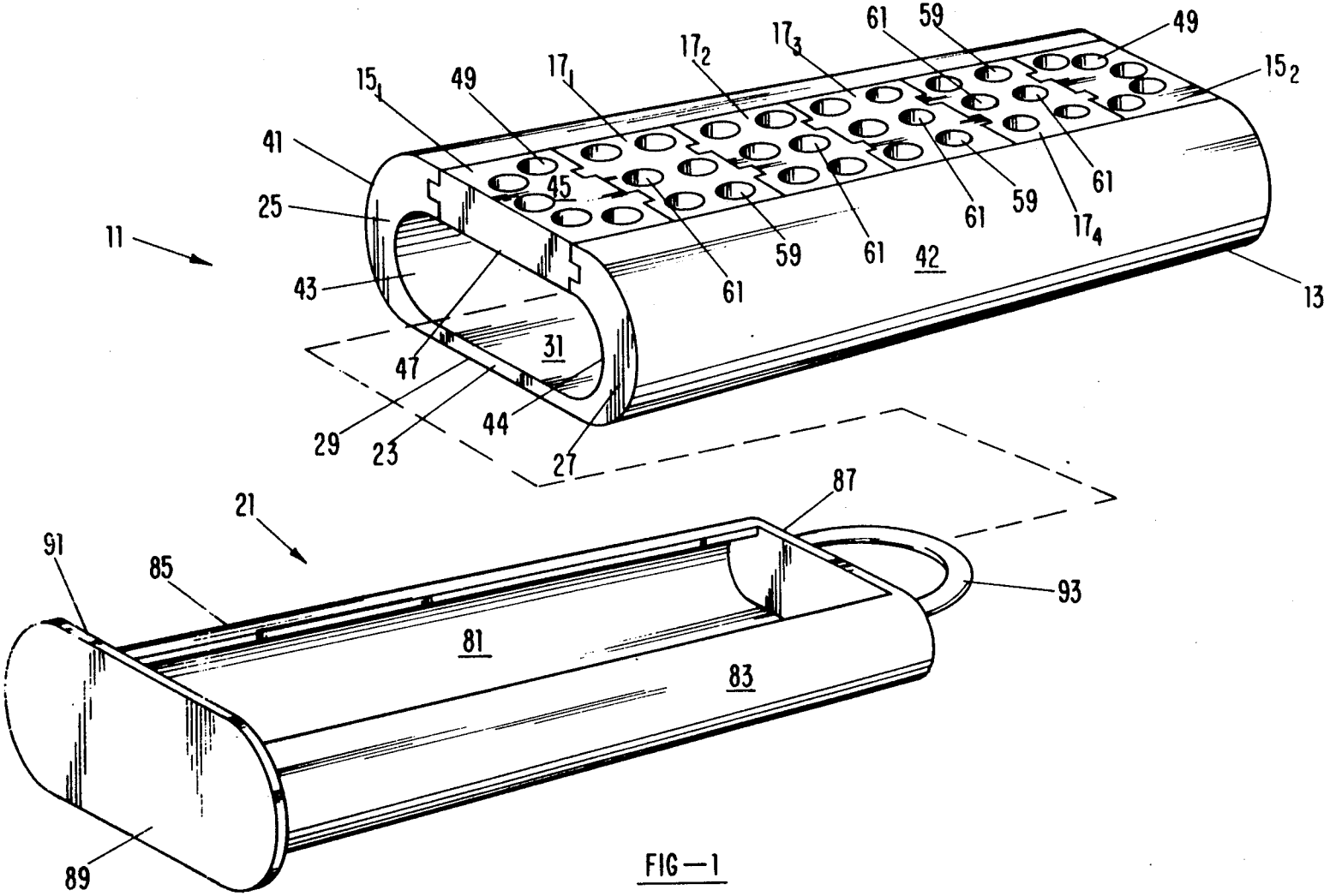
FIG. 1 is a perspective view of the first preferred embodiment of the present invention, showing the loom finger storage tray.
Figure 2:
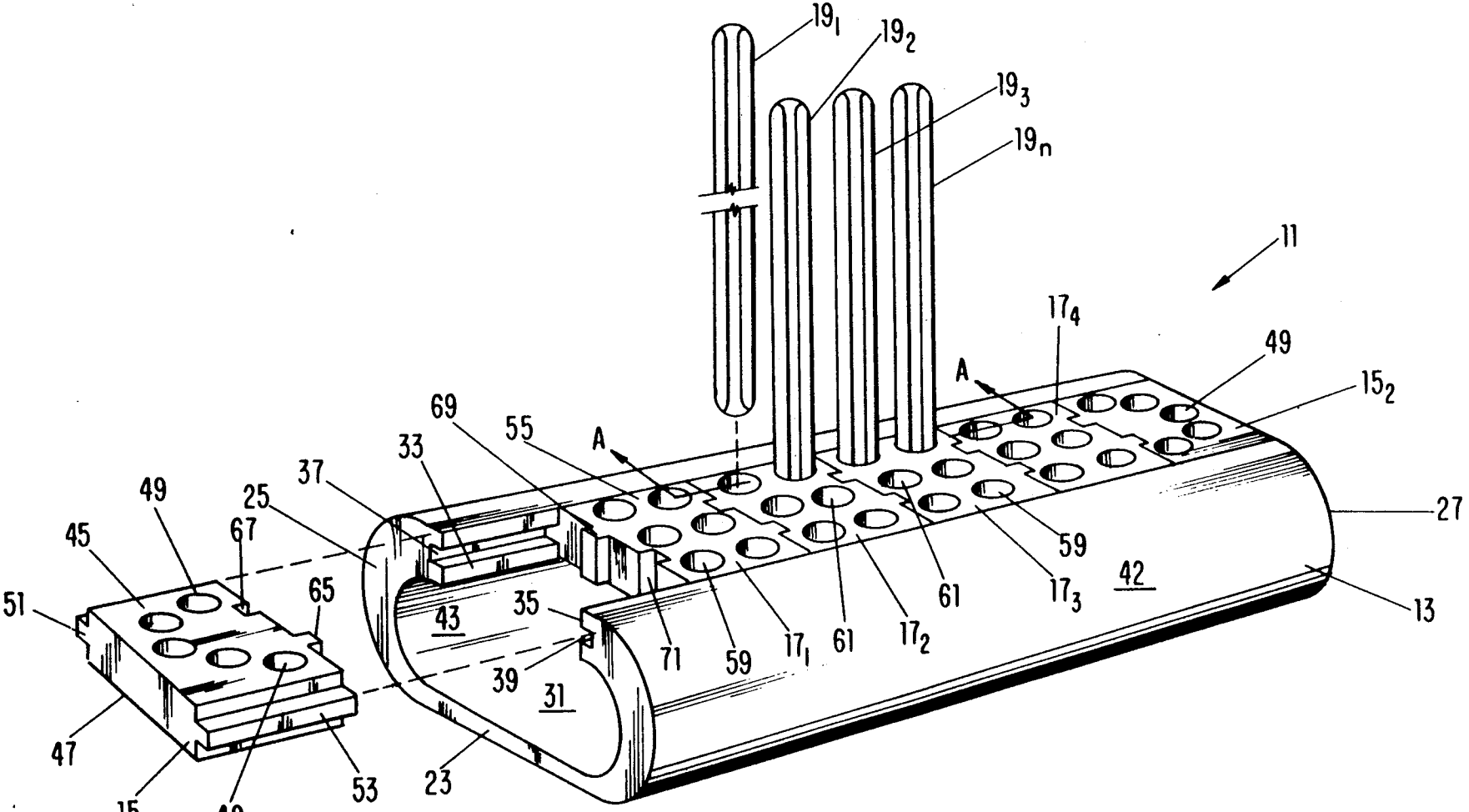
FIG. 2 is an additional perspective view of the embodiment of FIG. 1.
Figure 3:
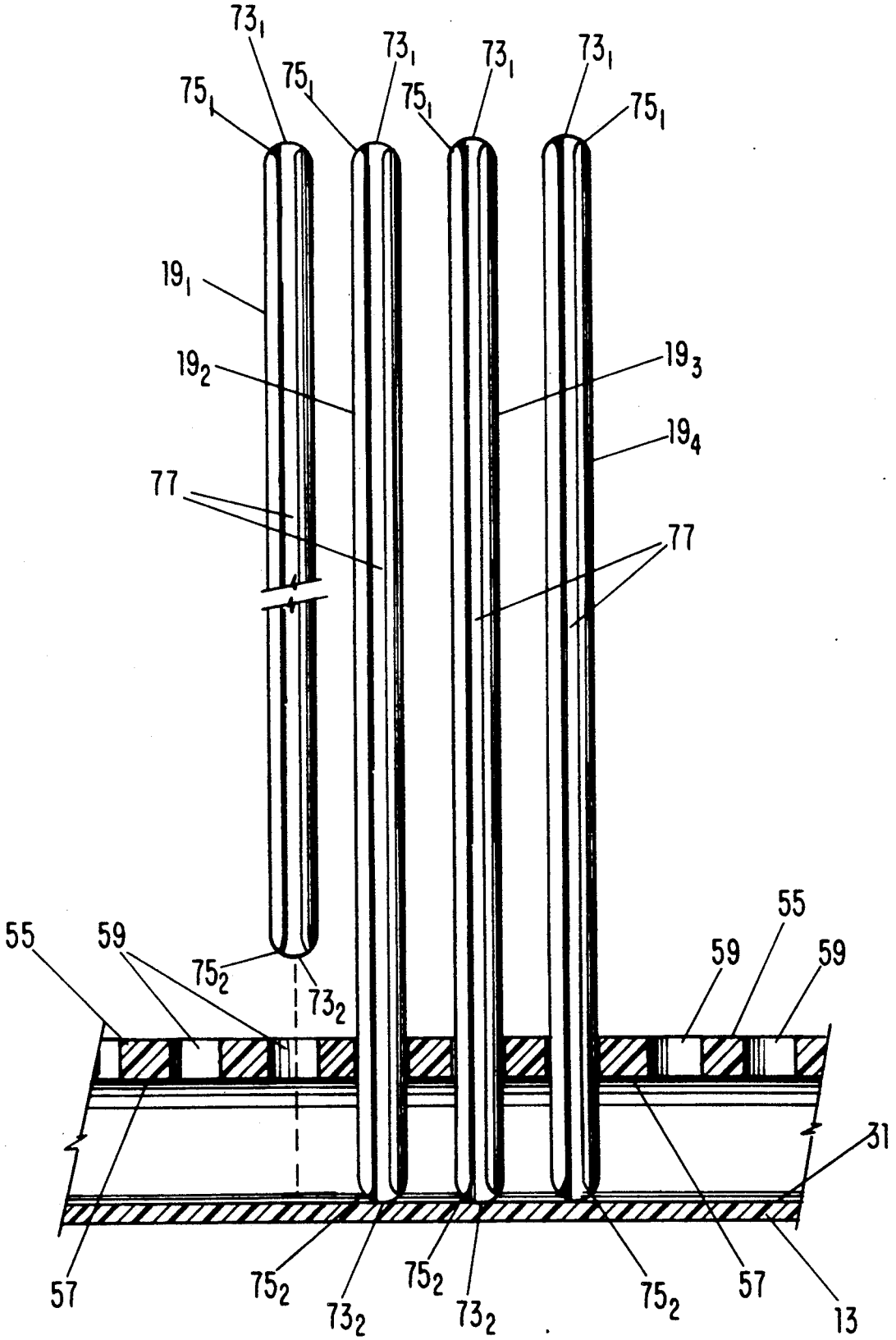
FIG. 3 is a sectional view of the first embodiment taken along lines A—A of FIG. 2.
Figure 4:
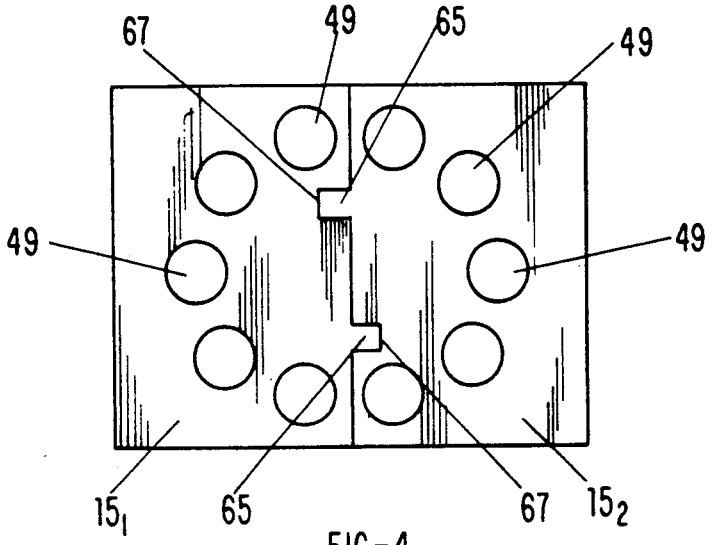
FIGS. 4, 5 and 6 are top plane schematics showing alternate tile and hole arrangements obtainable with the embodiment of FIG. 1.

With reference to FIGS. 1–3, loom 11 includes a base 13, two loom finger positioning end plates $15_{1\text{-}2}$, intermediate loom finger positioning plates $17_{1\text{-}4}$, and a plurality of loom fingers $19_{1,2,3...n}$. Loom 11 also includes loom finger and hook storage tray 21.

Base 13 includes a bottom portion 23, and integral curved side portions 25 and 27. Bottom portion 23 has a flat exterior surface 29 and an interior loom finger support surface 31. Side portions 25 and 27 terminate in opposing parallel faces 33 and 35 which have, respectively, facing longitudinal, parallel grooves 37 and 39. The exterior curved surfaces 41 and 42 are continuous with bottom surface 29; the interior surfaces 15 43 and 44, with surface 31.

Each plate 15 has a top surface 45, a bottom surface 47, and a plurality of loom finger receiving through openings 49. Each plate 15 also includes opposite and parallel tongues 51 and 53 which are designed to be slidably received in grooves 37 and 39 of base 13, as illustrated. Similarly, each plate 17 has a top surface 55, a bottom surface 57, a plurality of loom finger receiving perimeter through openings 59, and a plurality of loom finger receiving center through openings 61. Each plate 17 also has a pair of opposite and parallel tongues (not illustrated) which are also slidably received in grooves 37 and 39. When assembled with base 13, surfaces 45 and 55 lie in substantially the same plane which is continuous with curved surfaces 41 and 42. The distance between surfaces 45, 55 and 47, 57 and the diameter of openings 49, 59 and 61 are chosen such that plates 15 and 17 support a plurality of loom fingers 19 in substantially parallel fashion, without binding such loom fingers in their respective openings.

With reference of FIGS. 1, 2 and 4–6, it will also be seen that each plate $15_{1\text{-}2}$ has a tongue 65, and a notch 67. Similarly, each plate $17_{1\text{-}4}$ has a pair of tongues 69 and a pair of notches 71. Each tongue 65, 69 may have one or more dimples (not shown) for, in the assembled position, mating with depressions (also not shown) in the mating notches 67, 71, to form a unitary plate structure. However, as those skilled in the art will appreciate, the tongue and notch locking arrangement is optional and may be replaced with an alternate mechanism for holding plates 15 and 17 together, or dispensed with altogether.

Figure 5:
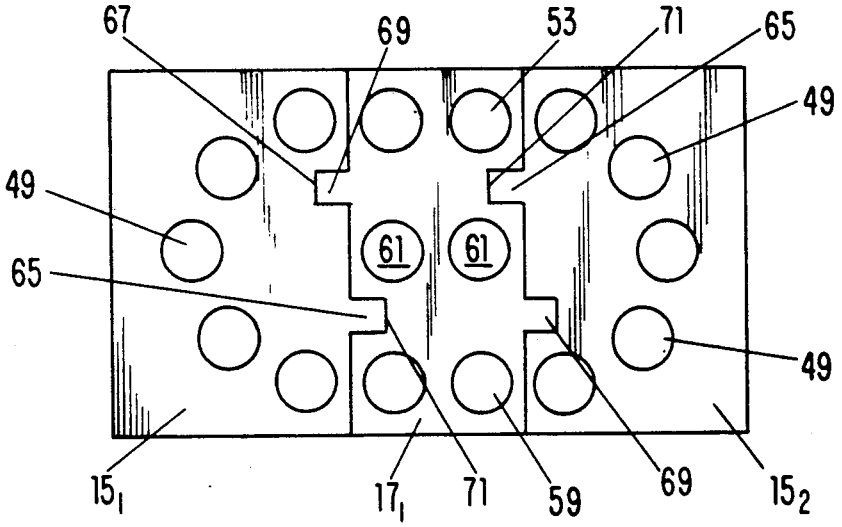
Figure 6:
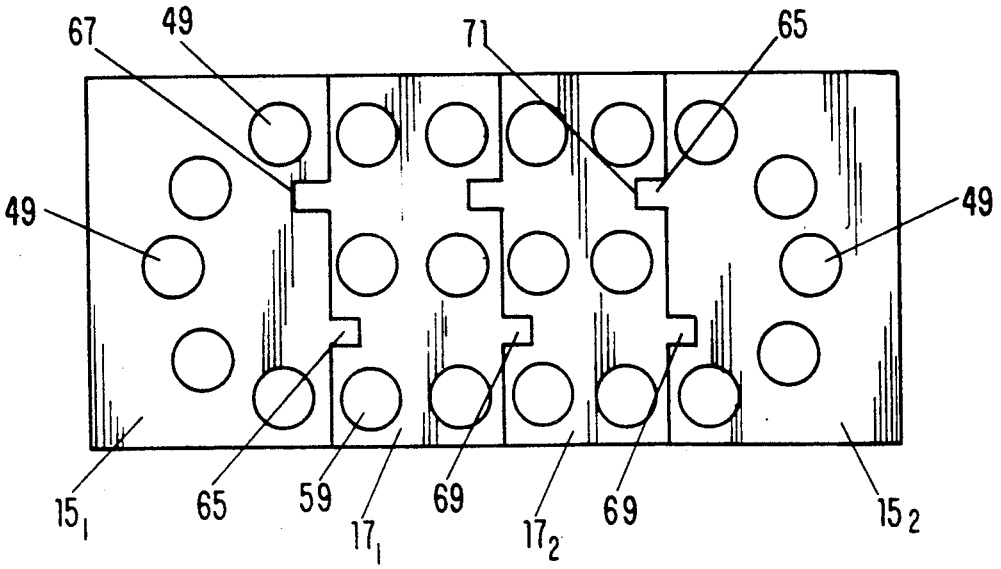

Also with reference to FIGS. 1, 5 and 6 it can be seen that the pattern of openings 49 and openings 59 is a closed loop. The pattern formed by openings 61 is a straight line. As is also evident with reference to FIGS. 4, 5, and 6, the number of plates held by base 13 can be varied to form the desired hole pattern (e.g. circle, oval, partial oval, semi-circle, or straight line) and the desired size. As should also be apparent to those skilled in the art, a single unitary plate having the desired hole pattern or patterns could be used instead of a plurality of plates $15_{1\text{-}2}$ and $17_{1\text{-}4}$. Further, long plates could be used to link two or more base members 13.

As is evident from FIGS. 2 and 3, each loom finger 19 has symmetrical ends $73_1$ and $73_2$, symmetrical tapered portions $75_1$, $75_2$ and an elongated groove 77 running the entire length thereof, which results in a C-shaped cross-section. As is also evident From FIGS. 2 and 3, each loom finger is slidably received in a through opening (49, 59 or 61, as the case may be) in plates 15 and/or 17, with one of its ends $73_2$ in contact with surface 31. Each loom finger 19 is formed of wood, plastic or metal.

Figure 8:
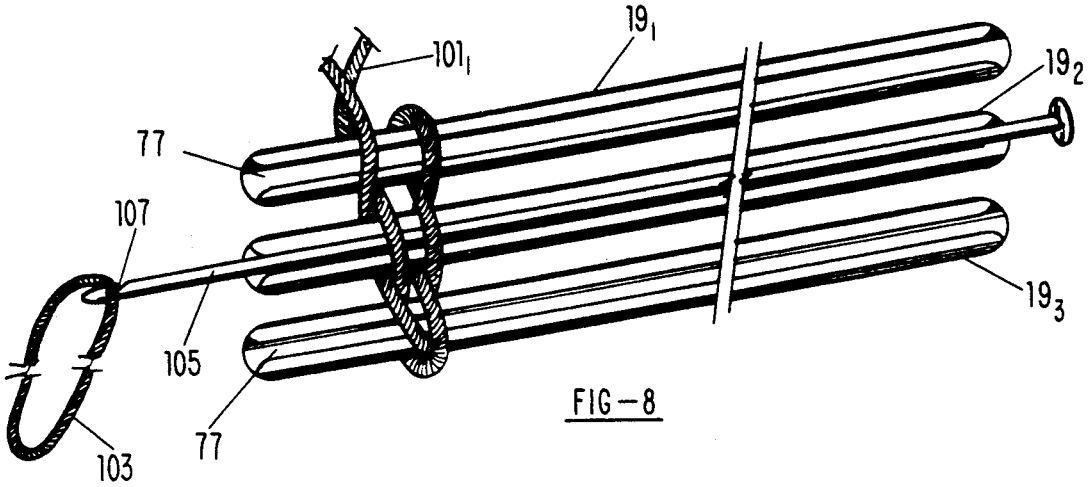
FIG. 8 is a perspective view illustrating the use of a hook and how it is used to pull the warp through the weft.

As an optional feature, loom 11 may also be provided with a storage tray 21 for loom fingers 19 and one or more hooks (such as illustrated in FIG. 8). Tray 21 includes an elongated channel portion 81, having curved exterior sides 83 and 85, a top end portion 87 and a bottom end portion 89. Exterior surfaces 83 and 85 and the bottom surface (not shown) are shaped and dimensioned to be slidable received within the channel formed by interior support surface 31 and surfaces 43 and 44. Bottom end portion 89 includes a continuous lip 91 which, when tray 79 is received within base 13, abuts one of the end faces of base 13. Channel portion 81 has the same length as base 13 so when tray 79 is received in base 13, the exposed face (not shown) of top end portion 87 is flush with other of the end faces of base 13. Top end portion 87 also includes a handle 93 which can be used for carrying or hanging up loom 11.

Base 13, tray 79 and plates $15_{1-2}$ and $17_{1-4}$ are, preferably, made of plastic. However, other materials such as wood or aluminum, or combinations thereof, could also be used.

In operation, with plates 15 and 17 assembled with base 13 as illustrated in FIGS. 2 and 3, the desired plurality of loom fingers $19_{1,2,3,4...}$ are slidably received in openings 49, 59 and/or 61. For each loom finger 19, one of its symmetrical ends $73_2$ touches and is supported by surface 31. While only four loom fingers 19 are illustrated, it will be appreciated that, for instance, an elongated straight line of loom fingers can be formed utilizing all of openings 61. Alternately, a closed oval can be formed utilizing all of openings 49 and 59. With the loom fingers $19_{1,2,3,4}$ positioned as illustrated in FIG. 3, the weft can be applied with any conventional soft weaving material such as knits, bias fabrics, twines and yarns, in any conventional manner. However, it is preferred to use closed loop material made from fabric which has some elasticity, such as closed loops made from T-shirt type material.

Figure 7A:
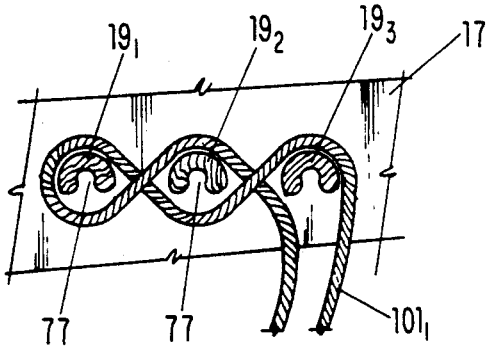
FIGS. 7A, 7B, 7C and 7D are partial views illustrating the preferred method of weaving or twining the weft.
Figure 7B:
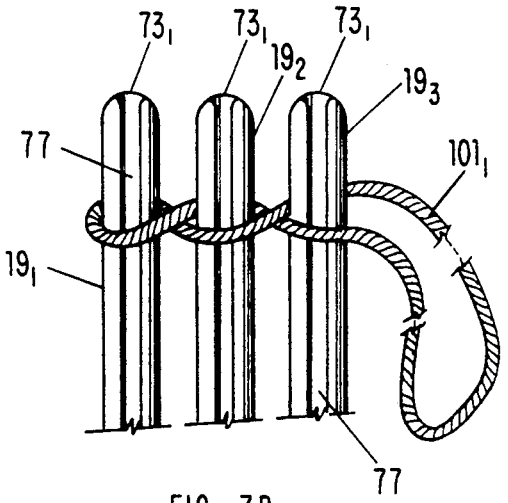
Figure 7C:
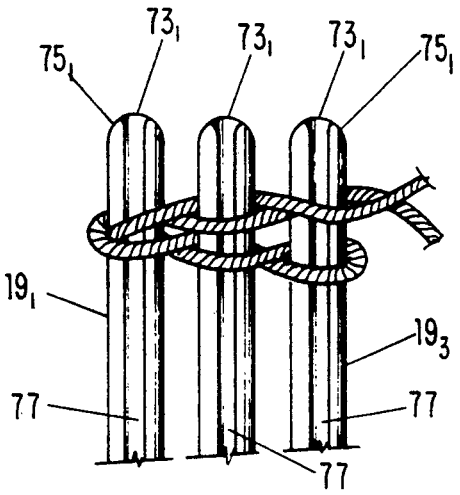
Figure 7D:
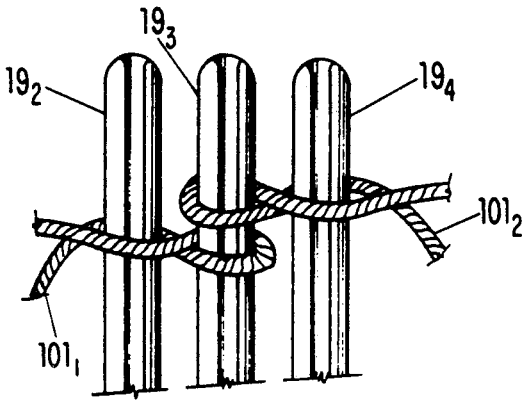

With reference to FIGS. 7A, 7B, 7C and 7D, the preferred and what is believed to be a unique weaving technique is illustrated. As illustrated in FIGS. 7A and 7B the closed loop weft $101_1$ is simultaneously wrapped around opposite sides of each loom finger $19_{1,2}$. When the user reaches the end of a row, Weft $101_1$ is double turned around loom finger 193, as illustrated in FIG. 7C. Weaving or twining of weft $101_1$ can proceed from left-to-right and then back (i.e., from right-to-left), which encourages the user to use opposite hands. Alternately, the position of loom 11 can be rotated 180°, as illustrated in FIG. 7C. The ending of weft $101_1$ is illustrated in FIG. 7D, as is the starting of a second weft 1012. The first loop of the second weft $101_2$ always goes on the same loom finger $19_3$ as the previous weft $101_1$ ended on. This procedure eliminates two of the major chores of conventional weaving: knotting and burying ends.

After the weft weaving or twining has been completed, it and loom fingers $19_{1-n}$ can easily be removed from loom 11. Removal of a completed weft from apparatus such as disclosed in Bacheller, U.S. Pat. No. 2,065,498, is likely to be slow as the weaving has to be carefully worked off the fixed loom fingers of the comb loom. Even if carefully worked off, this causes distortion of the weaving. In contrast, with loom 11 of the present invention, plates 15 and/or 17 are slidably removed from base 13 and then quickly pushed off loom fingers 19 by placing the ends 732, which were in contact with surface 31, onto a flat surface and then pushing plates 15 and/or 17 toward such flat surface, whereby the tapered end portions 752 of loom fingers 19 are only loosely received in openings 49, 59 and/or 61 and can be easily removed from plates 15 and/or 17.

With reference to FIG. 8, after removal of loom fingers $19_{1-n}$ from plates 15 and/or 17, warp thread 103 or other suitable material is inserted in the weft formation by attaching such warp to a conventional hook 105 which is passed through channels 77 of loom fingers 19. Preferably the hook portion 107 of hook 105 faces the inside of channel 77. After the warp has been added, each loom finger 19 can quickly and easily be removed on an individual basis, rather than trying to remove all loom fingers simultaneously, as required by Bacheller, U.S. Pat. No. 2,065,498.

Figure 9A:
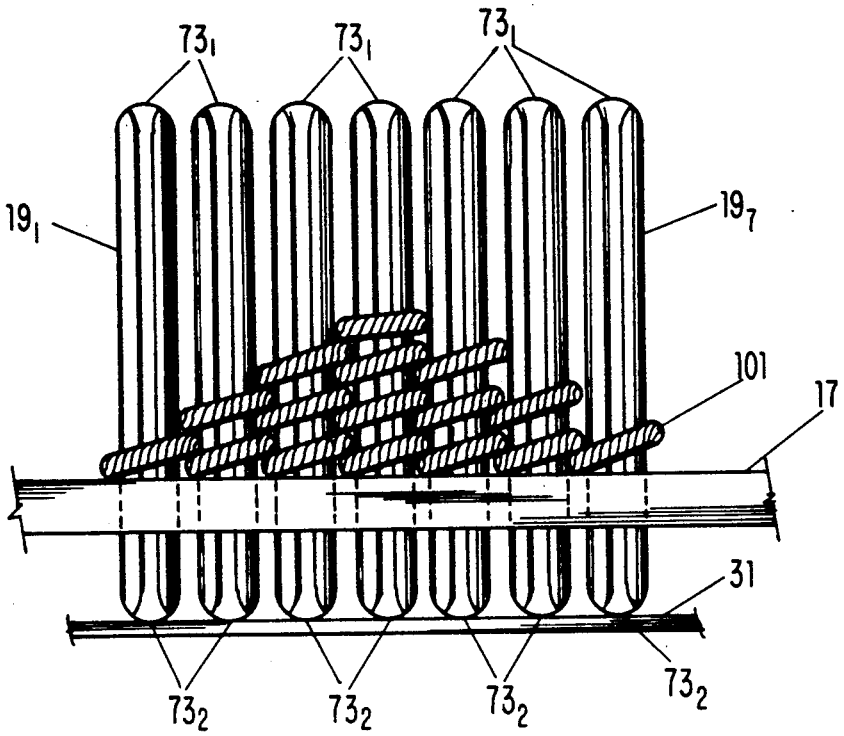
FIGS. 9A and 9B are schematics illustrating the method of weaving by reversing the direction of the loom fingers.
Figure 9B:
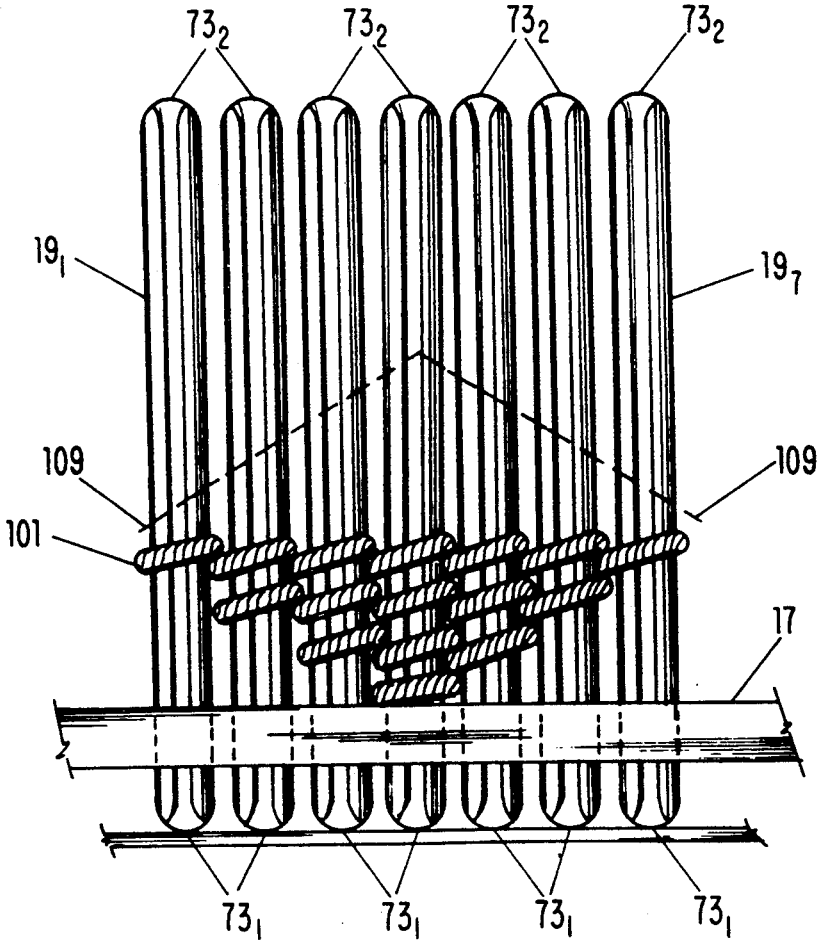

The ability to quickly and easily remove loom fingers 19 (together with the weft formation thereon) from plates 15 and/or 17 provides an additional unique advantage of permitting weaving from the center out. For instance, as schematically illustrated in FIGS. 9A and 9B, a diamond pattern is easily created, by first weaving a triangle as illustrated in FIG. 9A. Loom fingers $19_{1,2,3,4,5,6,7}$ are then separated from plates 17 in the manner set forth above, plates 17 reassembled with base 13 and loom fingers $19_{1,2,3,4,5,6,7}$ reinserted such that Opposite ends $73_1$ now engage surface 31 of base 13. Weaving or twining of the other half of the diamond, such as illustrated by phantom lines 109 may now proceed with, for instance, the same type and color material. The foregoing is in contrast with conventional weaving techniques where, to weave a diamond or other shape, one has to weave the background first. For many people, particularly novice weavers, this is conceptually difficult.

Figure 10:
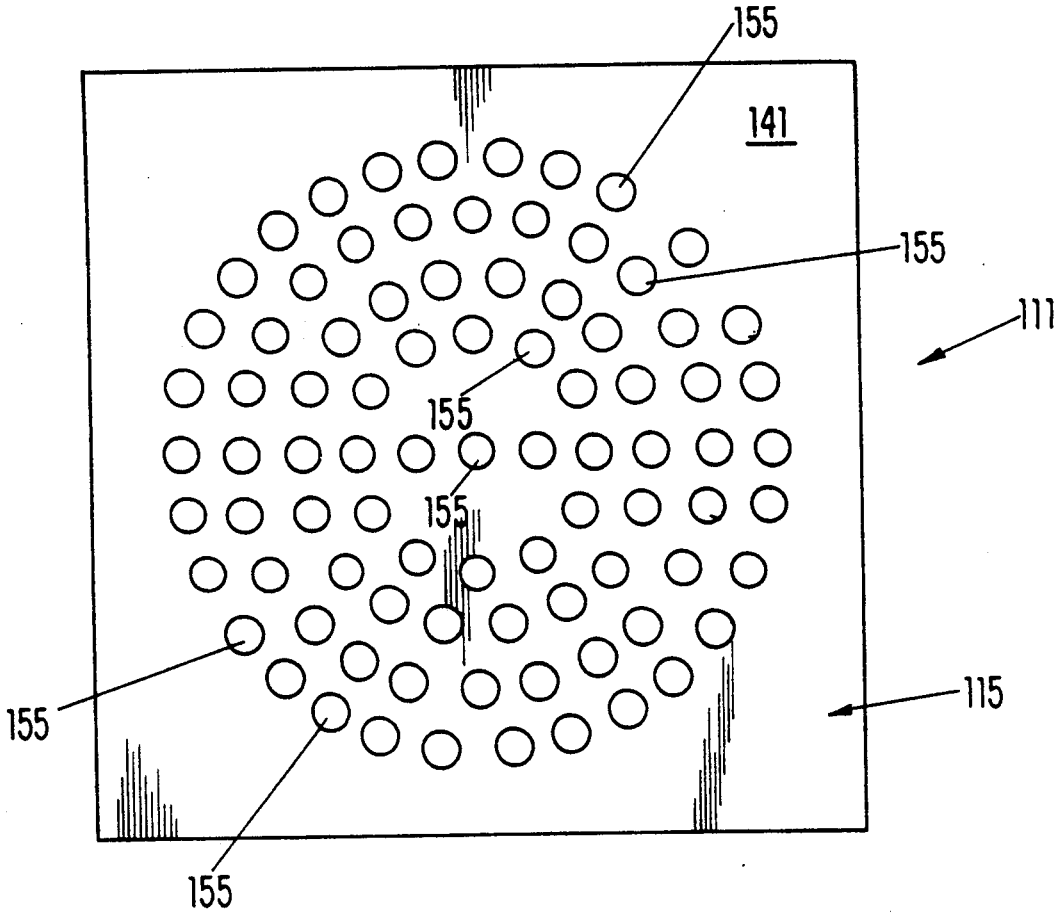
FIG. 10 is a top plane view of an alternate embodiment of the present invention.
Figure 11:
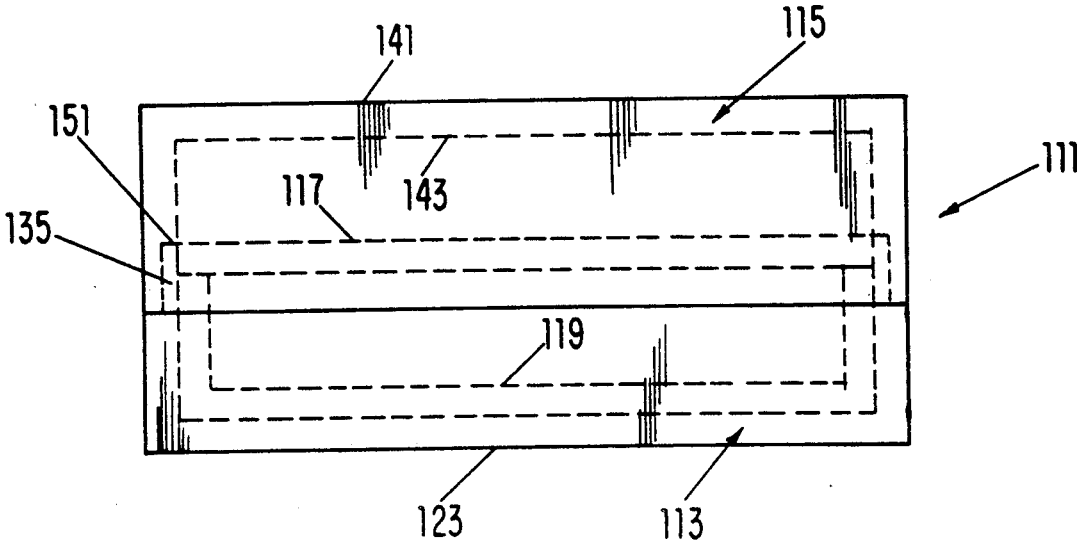
FIG. 11 is an end view of the embodiment of FIG. 10.
Figure 12:
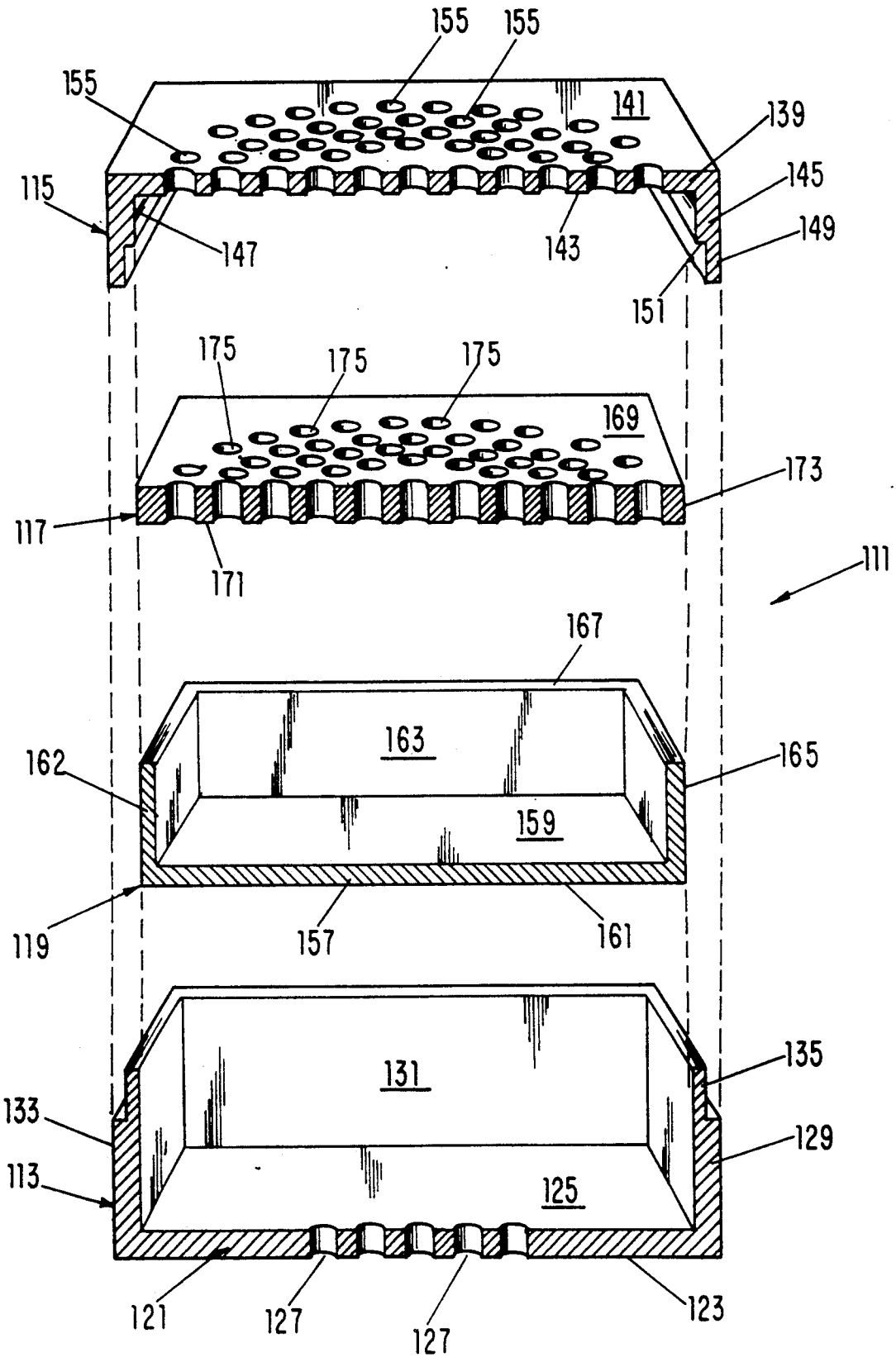
FIG. 12 is an exploded perspective view of the embodiment of FIG. 10.

With reference to FIGS. 10, 11 and 12, alternate loom embodiment 111 is illustrated. Loom 111 includes a base 113, a top 115, a master plate 117, and an intermediate and reversible tray 119. For purpose of illustration the width and breadth of loom 111 are reduced in scale. Wall thickness is also not to scale.

Base 113 includes a bottom 121, having an exterior surface 123 and a parallel interior surface 125, and a plurality of through loom finger receiving openings 127. Openings 127 are evenly spaced along a line which bisects bottom 121. Base 113 also includes a continuous side having an interior surface 131, an exterior surface 133 and a continuous lip 135.

Top portion 115 includes: a top 139, having exterior surface 141 and interior surface 143; and a continuous side 145, which includes interior surface 147, exterior surface 149, and continuous shoulder 151. As illustrated in FIG. 11, when assembled with base 113, lip 135 seals against shoulder 151; surfaces 133 and 149 form a continuous exterior side surface; and surfaces 131 and 147 form a smooth continuous interior side surface. As best illustrated in FIG. 10, top 139 includes a plurality of loom finger receiving through openings 155, with three in the middle and the rest evenly distributed around four concentric circles. The three middle openings, together with opposing pairs on each of the concentric circles form a straight line of eleven openings.

Reversible tray 119 includes a bottom 157, having interior surface 159 and exterior surface 161; and a continuous side 162, having interior surface 163, exterior surface 165 and continuous top edge 167. Tray 119 is dimensioned such that it fits, without too much lateral play, within both the interior of base 113 (as illustrated in FIGS. 11 and 12) or, alternatively, within the interior of top portion 115. When received in top portion 115, exterior surface 161 is in contact with interior surface 143.

Master plate 117 includes a top surface 169, a bottom surface 171, a continuous edge 173, and a plurality of loom finger receiving openings 175. The pattern of openings 175 matches that of openings 155; eleven in a straight line in the middle, the rest evenly distributed around four concentric circles.

In operation, with loom 111 assembled as illustrated in FIGS. 11 and 12, with plate 117 resting on top edge 167. A plurality of loom fingers $19_{1-n}$ is then placed in openings 155 and matching openings 175 in the desired pattern, with the loom finger ends $73_2$ resting on surface 159 of tray 119. A straight line of up to eleven loom fingers is one pattern option; a continuous circle using the openings in the outermost concentric circle is another. After the weft is twined on loom fingers $19_{1-n}$, top portion 115 of loom 111 is separated from base 113. Because of the lateral forces placed on loom fingers $19_{1-n}$ by the weft, loom fingers $19_{1-n}$, top 115 and plate 117 are held together. Tray 119 is then removed from base 113 and placed on a flat surface with edge 167 in contact with such flat surface. The ends $73_2$ of loom fingers 191-n are then placed in contact with surface 161 and plate 117 and top 115 pushed in a downward direction to move such loom fingers $19_{1-n}$ upward to the point where the tapered portions $75_2$ are loosely received in openings 155 and 175 and can easily be removed therefrom.

If the user is a beginner, loom 111 can be flipped over so that the five hole pattern of openings 127 is exposed. Internally, the positions of tray 119 and plate 117 are reversed. Tray 119 is also flipped over, such that interior surface 159 faces one of surfaces 169, 171 of plate 117. The center five openings 175 of plate 117 match the straight line pattern of holes 127 in base 113. The operation of twining, removing the loom fingers from the loom, inserting the warp and then removing the loom fingers $19_{1-5}$ is the same as described above.

Figure 13:
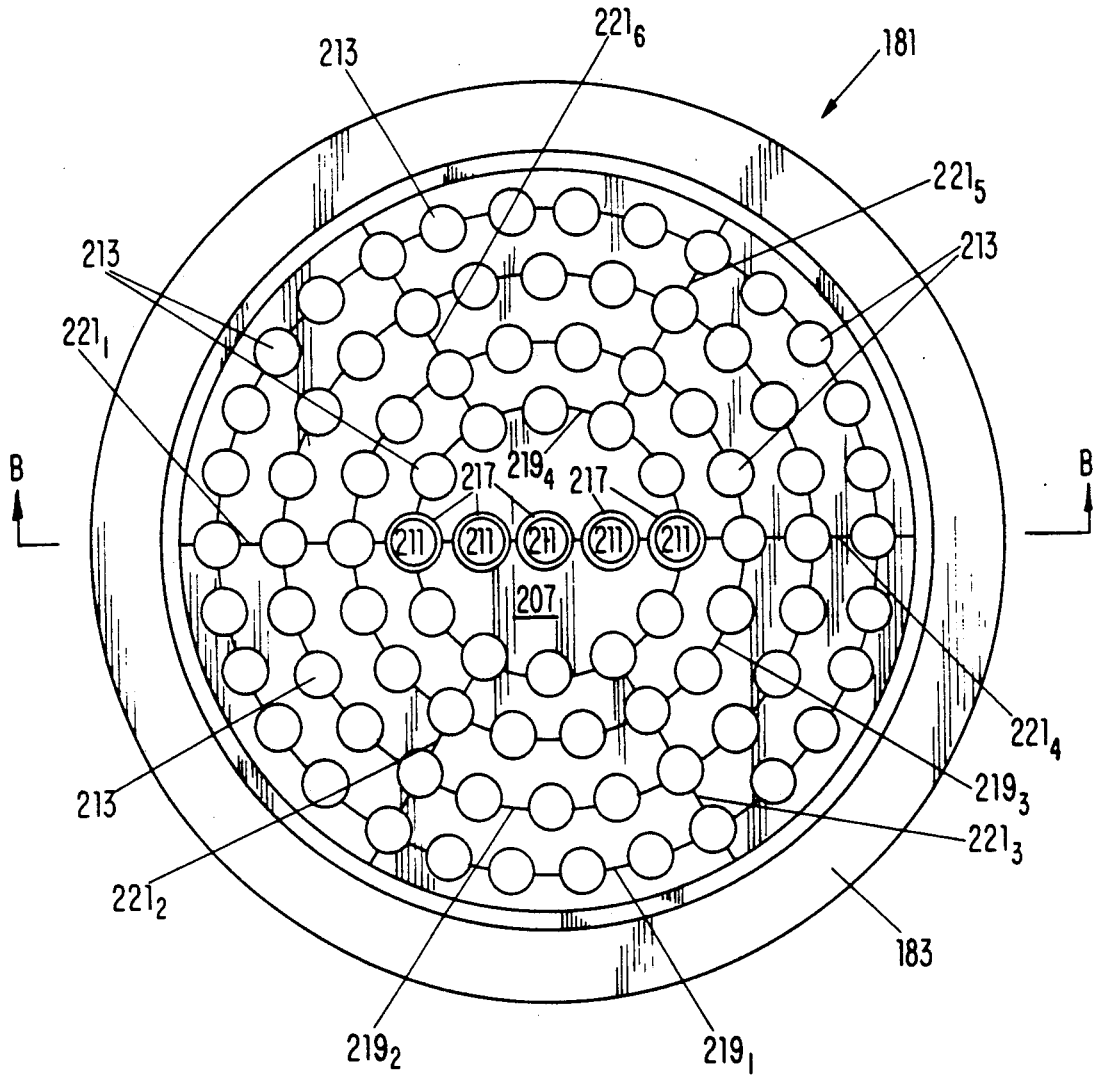
FIG. 13 is a top plane view of a third preferred embodiment of the present invention.
Figure 14:
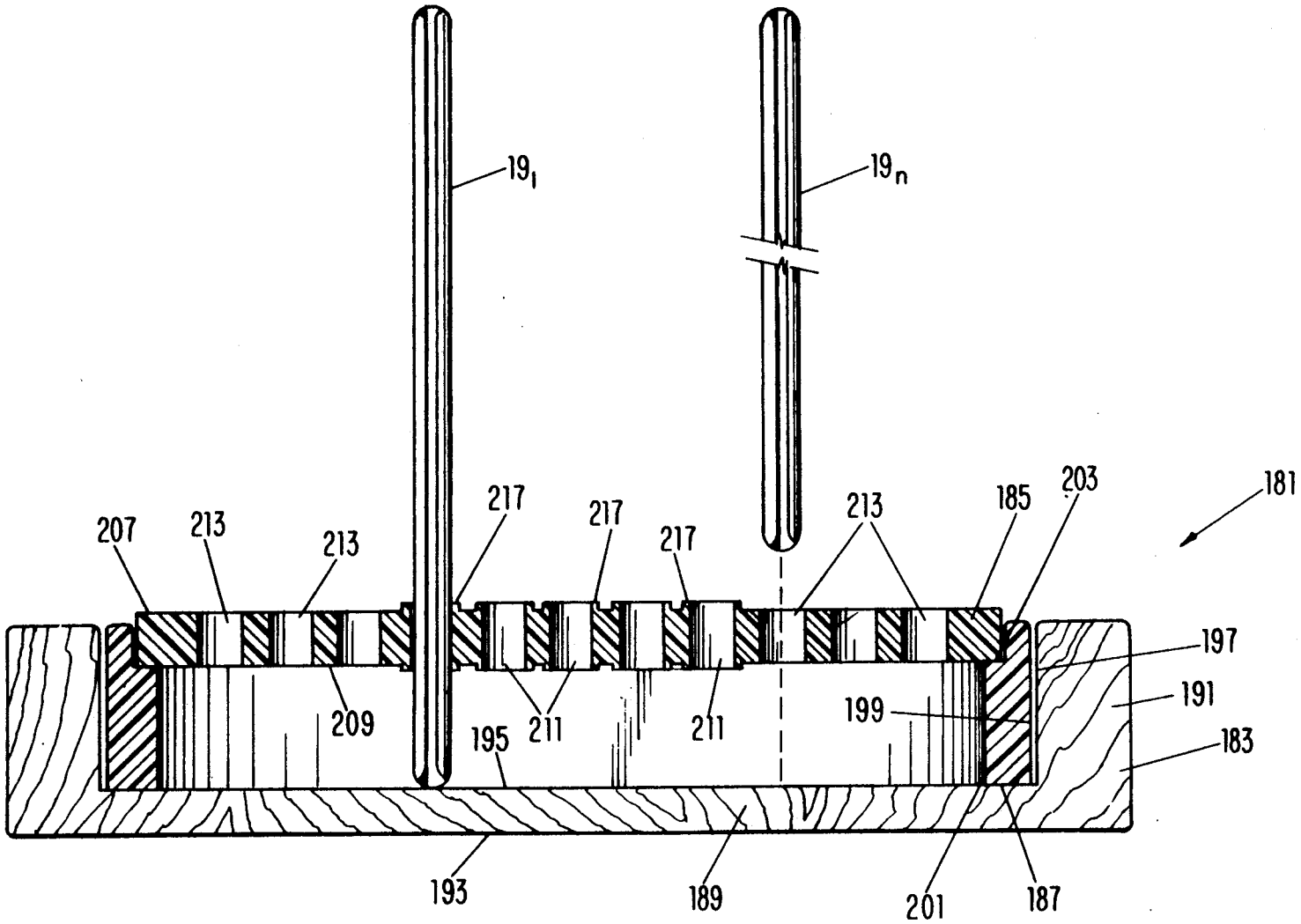
FIG. 14 is a sectional view of the embodiment of FIG. 13, taken along lines B—B, with the addition of loom fingers.

A third embodiment of the invention is illustrated in FIGS. 13 and 14. Loom 181 includes a base 183, a loom finger positioning plate 185, a ring member 187 and a plurality of loom fingers $19_{1-n}$. Base 183 includes a bottom portion 189 and a donut shaped side portion 191. Bottom portion has a flat exterior support surface 193 and a flat interior support surface 195. Side portion 191 includes an interior cylindrical surface 197. Ring 187 has an exterior cylindrical surface 199, a bottom surface 201 and an annular notch 203. Ring 187 and base 183 are made of suitable materials, such as plastic and wood, with cylindrical surface 199 dimensioned to be slidably and rotatably received within cylindrical surface 197, without either binding or undue slop.

Plate 185, which serves the same function as plates 15 and/or 17, includes a top surface 207, a parallel bottom surface 209 and a plurality of loom finger receiving through holes $211_{1-5}$ and $213_{1-n}$. Plate 185 also includes a cylindrical edge 215 which is dimensioned to slidably fit within notch 203 in ring 187. Openings 211 and 213 all have the same diameter. Openings 211 are, however, each provided with a raised cylindrical collar 217 to make the line defined by these openings more visible to the user, particularly the visually impaired user. As with the embodiment of FIGS. 1–3, the distance between surfaces 207 and 209 and the diameter of openings 211 and 213 is such that, when assembled, loom fingers 19 are held in substantially parallel fashion. Top surface 207 is also inscribed with a pattern of circular lines $219_{1-4}$ and straight lines $221_{1-6}$ to identify potential loom finger patterns for the user.

In operation, the embodiment of FIGS. 13 and 14 is the same as that of the embodiment of FIGS. 1–3. The pattern of openings 211 and 213 permits the formation of both rectangular and cylindrical woven articles. The use of ring 187 permits plate 185 to be rotated relative to base 183 for the convenience of the user, without undue wobbling of plate 185 relative to base 183.

Whereas the drawings and accompanying description have shown and described the preferred embodiment of the present invention, it should be apparent to those skilled in the art that various changes may be made in the form of the invention without affecting the scope thereof.

What I claim is:

1. A loom comprising:

(a) a plurality of elongated loom finger elements, each of said elements having a first and a second end and an elongated groove therein, each said groove running the length of each said element;

(b) a first loom finger support means including first and second surfaces interconnected by a plurality of openings, each of said openings adapted to slidably receive one of said loom finger elements, said surfaces being spaced from each other a distance which, in conjunction with the diameter of said openings is sufficient to position said plurality of said loom finger elements in substantially parallel fashion;

(c) a second loom finger support means, said second support mean including a third surface for supporting one of said first or second ends of each of said loom finger elements when said first loom finger support means is assembled with said second loom finger support means and when said loom finger elements are received in said openings of said first loom finger support means; and (d) means provided on said first and second loom finger support means for detachably assembling said first loom finger support means relative to said second loom finger support means, whereby said first and second surfaces are spaced altitudinaly with respect to said third surface, and whereby each of said loom finger elements passes through one of said openings in said first loom finger support means has its said first or second end in contact with said third surface, and whereby, when said means for detachably assembling are not positioning said first loom finger support means relative to said second loom finger support means, said loom finger elements can be moved relative to said openings by moving said first loom finger support means toward said ends which contacted said third surface.

2. The loom as set forth in claim 1, wherein said first loom finger support means comprises at least one plate-like member, and said second loom finger support means includes at least one side portion, said means for detachably assembling being provided on said first loom finger support means and said side portion.

3. The loom as set forth in claim 2, wherein said second finger support means includes two side portions which define a generally U-shaped channel member, said means for detachably assembling being provided on said, first loom finger support means and said side portions.

4. The loom as set forth in claim 3, wherein said side portions have a pair of elongated grooves therein and said plate-like member has a pair of tongues which are slidably received in said grooves, whereby said plate-like member may be detached from said second loom finger support means by a sliding motion to expose each of said one of said first or second ends which had been in contact with said third surface.

5. The loom as set forth in claim 3, wherein said first loom finger support member comprises a plurality of plate-like members, each of said members having a pair of tongues and at least one said openings, which plate-like members can be selectively added and/or interchanged to vary the number of said openings available for said loom finger elements.

6. The loom as set forth in claim 5, wherein each of said plate-like members includes means for interlocking with an adjacent said plate-like member.

7. The loom as set forth in claim 3, further including an elongated tray for the storage of said loom finger elements which is slidably received within said second loom finger support means.

8. The loom as set forth in claim 2, wherein said side portion is a continuous closed perimeter which, in conjunction with said third surface, defines a cavity, said third surface defining the bottom of said cavity.

9. The loom as set forth in claim 8, wherein said plate-like member has said plurality of openings therein, which openings are arranged in circular, linear and semi-circular patterns which permit a multitude of choices for positioning said loom finger elements.

10. The loom as set forth in claim 8, wherein said plate-like member is disc shaped, said continuous side portion includes an annular ring, said means for detachably assembling including a lip on said ring, said disc shaped plate being rotatably received in said annular ring.

11. The loom as set forth in claim 10, wherein said ring is separate from said side portion and is received in said cavity for rotation relative to said side portion.

12. The loom as set forth in claim 1, wherein said first loom finger support means includes a first plate-like member having a plurality of said openings therein, said first loom finger support means also including a second plate-like member spaced from first plate-like member and having a plurality of said openings therein, said openings in said second plate-like member being in alignment with at least some of said openings in said first plate-like member.

13. The loom as set forth in claim 12, wherein said second loom finger support means includes a third plate-like member, and wherein said loom includes a fourth plate-like member having a plurality of openings therein which are in alignment with some of said openings in said second plate-like member.

14. The loom as set forth in claim 13, wherein said means for detachably assembling said finger support means and said second finger support means includes mating portions on said first and fourth plate-like members.

15. The loom as set forth in claim 14, wherein both said first plate-like member and said fourth plate-like member include projecting lips, said lips cooperating to, in the assembled loom, form a box-like structure.

16. The loom as set forth in claim 13, further including means on said third plate-like member for supporting said second plate-like member relative to both said first and fourth plate-like members.

17. The loom as set forth in claim 16, wherein said third plate-like member is a tray-like member having a flat bottom, said flat bottom forming said third surface.

18. The loom as set forth in claim 17, wherein said tray-like member can be placed on either side of second plate-like member for supporting said second plate-like member.

19. A method of twining or weaving comprising the steps of:

(a) positioning a plurality of elongated loom finger elements having first and second tapered ends and an elongated groove therein in a support which includes first and second movable member contacting said first tapered ends;

(b) wrapping weft on said loom finger elements;

(c) moving said loom finger elements substantially in unison relative to said first movable member whereby said first tapered ends are loosely received in said openings;

(d) removing said loom fingers and said weft, as a unit, from said first movable member;

(e) inserting warp to said weft; and (f) removing said loom fingers from said warp and said weft.

20. The method as set forth in claim 19, wherein the warp can be inserted from either end of said loom finger elements.

21. The method as set forth in claim 19, wherein said loom finger elements are removed from said weft and warp without distorting said weft and warp.

22. The method as set forth in claim 19 wherein, after said loom fingers and said weft are removed from said first moveable member and before inserting said warp, said second ends of said loom fingers are inserted in said openings, and said loom fingers are moved relative to said first member until said second tapered ends contact said second moveable member, whereby the direction of wrapping said weft is reversed without removing said weft from said loom finger elements.

23. The method as set forth in claim 19, wherein said movement of said loom finger elements relative to said first moveable member includes the steps of moving said first member relative to said second member to expose said first ends, and further including the step of then contacting said first ends with a surface to move said loom finger elements relative to said first movable member whereby said first tapered ends are loosely received in said openings.

24. The method as set forth in claim 23, wherein said movement of said first member relative to said second member is a lateral sliding movement.

25. A method of twining comprising:

(a) positioning a plurality of loom finger elements in a spaced array;

(b) twining a piece of closed loop material on said fingers;

(c) ending said closed loop material on one of said fingers; and (d) starting a second piece of closed loop material on said one of said fingers.

* * * * *